US011028862B2

(12) United States Patent
Pogatschnigg et al.

(10) Patent No.: US 11,028,862 B2
(45) Date of Patent: Jun. 8, 2021

(54) METERING HYDRAULIC CONTROL SYSTEM FOR MINING MACHINE

(71) Applicant: SANDVIK INTELLECTUAL PROPERTY AB, Sandviken (SE)

(72) Inventors: Reinhold Pogatschnigg, Katsch an der Mur (AT); Christian Umundum, Spielberg (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 136 days.

(21) Appl. No.: 16/487,083

(22) PCT Filed: Feb. 24, 2017

(86) PCT No.: PCT/EP2017/054341
§ 371 (c)(1),
(2) Date: Aug. 19, 2019

(87) PCT Pub. No.: WO2018/153477
PCT Pub. Date: Aug. 30, 2018

(65) Prior Publication Data

US 2021/0131066 A1 May 6, 2021

(51) Int. Cl.

| | |
|---|---|
| ***F15B 11/00*** | (2006.01) |
| ***E02F 9/22*** | (2006.01) |
| ***E21C 27/38*** | (2006.01) |
| ***F15B 13/06*** | (2006.01) |

(52) U.S. Cl.
CPC ..... *F15B 11/006* (2013.01); *E02F 9/2203* (2013.01); *E02F 9/2228* (2013.01); *E02F 9/2285* (2013.01); *E21C 27/38* (2013.01); *F15B 13/06* (2013.01)

(58) Field of Classification Search
CPC ..... F15B 11/006; F15B 13/06; F15B 13/07
See application file for complete search history.

(56) References Cited

U.S. PATENT DOCUMENTS

| | | | | |
|---|---|---|---|---|
| 4,250,794 | A | 2/1981 | Haak et al. | |
| 5,794,511 | A * | 8/1998 | Sorbel | E02F 9/2267 91/536 |
| 6,431,050 | B1 | 8/2002 | Hausman et al. | |
| 6,467,264 | B1 * | 10/2002 | Stephenson | F15B 11/006 60/368 |
| 6,748,738 | B2 * | 6/2004 | Smith | E02F 9/2217 60/414 |
| 7,905,088 | B2 * | 3/2011 | Stephenson | F15B 11/024 60/414 |

(Continued)

FOREIGN PATENT DOCUMENTS

| | | | |
|---|---|---|---|
| JP | S60203742 | A | 10/1985 |
| RU | 238734 | C1 | 4/2010 |

(Continued)

*Primary Examiner* — Michael Leslie
(74) *Attorney, Agent, or Firm* — Corinne R. Gorski

(57) ABSTRACT

A hydraulic system arranged to control at least two hydraulic actuators via a metering control valve assembly. The hydraulic system is advantageous to control a pivoting arm of an undercutting mining machine according to at least two modes of operation including an idling mode and a cutting mode. In particular, the hydraulic actuators may be controlled by quantitative variation of fluid flow speed and pressure.

17 Claims, 6 Drawing Sheets

(56) References Cited

U.S. PATENT DOCUMENTS

| | | | | |
|---|---|---|---|---|
| 9,068,578 | B2 * | 6/2015 | Opdenbosch | E02F 9/2289 |
| 9,151,081 | B2 * | 10/2015 | Thomson | E05B 65/5284 |
| 10,358,797 | B2 * | 7/2019 | White | E02F 9/2267 |
| 10,526,767 | B2 * | 1/2020 | Hijikata | E02F 9/2217 |
| 2002/0148223 | A1 | 10/2002 | Reiners et al. | |
| 2003/0106423 | A1 | 6/2003 | Hajek et al. | |
| 2012/0152629 | A1 | 6/2012 | Mather et al. | |
| 2013/0081383 | A1 | 4/2013 | Knussman | |
| 2014/0325972 | A1 * | 11/2014 | Ma | E02F 9/2292 60/327 |

FOREIGN PATENT DOCUMENTS

| | | | |
|---|---|---|---|
| SU | 1652468 | A1 | 5/1991 |
| WO | 2016055087 | A1 | 4/2016 |

* cited by examiner

METERING HYDRAULIC CONTROL SYSTEM FOR MINING MACHINE

RELATED APPLICATION DATA

This application is a § 371 National Stage Application of PCT International Application No. PCT/EP2017/054341 filed Feb. 24, 2017.

FIELD OF INVENTION

A hydraulic system to provide actuation of a mechanical member, and in particular although not exclusively, to a hydraulic system having an actuator with independent metering control.

BACKGROUND ART

Independent metering valve (IMV) assemblies have been used for hydraulic control of actuators of heavy machinery that act on excavation buckets, loader front ends and the like. Typically, an IMV assembly receives pressurised hydraulic fluid from a pump and is coupled in fluid communication with a hydraulic load actuator such as a hydraulic cylinder that is mechanically linked to a mechanical actuator, i.e. loader bucket, mechanical arm etc. Conventionally, an IMV assembly includes four independently controllable valves in which a first pair is coupled with a first chamber (head end) of the cylinder and a second pair is coupled with a second chamber (rod end) such that selective hydraulic fluid flow between the respective pairs of valves provides either extension or retraction of the cylinder rod. Typically, the valves of the IMV assembly are electrically controlled independently and are configured to receive input signals from one or more sensors provided at the hydraulic circuit.

US 2013/0081383 discloses a hydraulic system in which a variable displacement pump is connected in a closed-loop manner to first and second linear actuators that operate to manipulate a pivoting boom of an excavator machine.

US 2003/0106423 discloses a fluid control system operable in either an independent function mode or a regenerative function mode.

US 2002/0148223 discloses a hydraulic system having a IMV assembly coupled to a first and second hydraulic load such as a cylinder or fluid motor driving a fan or the like.

However, conventional arrangements offer limited control of fluid flow speed, pressure and fluid flow direction through the circuit that in turn limits the range of functionality of the hydraulic and according the mechanical actuator. Accordingly, what is required is a hydraulic system that solves these problems.

SUMMARY OF THE INVENTION

It is one objective of the present invention to provide a hydraulic system capable of being fluidly connected to an actuator so as to provide a wide range of dynamic (adjustable) properties including in particular load force, speed of movement, accurate static and moving positional control in response to an external static and/or dynamic load forces. It is a further specific objective to provide a hydraulic system suitable for controlling a mechanically actuating member such as a boom, arm, linkage or other member associated with heavy machinery such as an excavator, mining machine or other bulk processing apparatus.

It is a specific objective to provide a hydraulic system for a cutting mining machine and in particular an undercutting mining machine capable of controlling actuation of one or more pivoting support arms of the machine that mount one or a plurality of cutting heads.

According to one aspect, a hydraulic system is provided having an independent metering valve (IMV) assembly in which electrically controlled meter-in and meter-out valves are configured to control a mechanical actuator (such as a cutter arm) to provide accurate movement and static positioning of the mechanical actuator both when the actuator is not externally loaded (other than by gravity) and in response to an external static and/or dynamic load forces. The present hydraulic system is specifically adapted for variation of speed of actuation and the force with which actuation is provided. For example, and in one mode of operation, hydraulic actuating cylinders, controlled by the present hydraulic system, may be maintained in a relatively 'stiff' configuration so as to be capable of withstanding significant loading forces, e.g., when the cutter arm is in a cutting mode, whilst maintaining position or whilst being actuated to provide pivoting of the cutter arm against the rock strata e.g., movement laterally inward and outward relative to a main body of the bulk processing machine. In a further mode of operation, the hydraulic actuating cylinders, may be controlled to provide fast movement of the cutter arm when not loaded e.g., when the cutting arm is in an idling (not cutting) mode.

The present hydraulic system is advantageous to provide independent metering of movable mechanical actuators such as pivoting support arms of cutting or other mining machines and other bulk processing apparatus. In particular, the subject invention provides control of one or a plurality of hydraulic load actuators (e.g. hydraulic cylinders) according to different operational modes such as a 'cutting' mode and an 'idling' mode. In the cutting mode the system is configured to control the hydraulic actuator to achieve a slow speed or movement with high loading force resistance (i.e., enhanced relative 'stiffness' of the actuator) and in the cutting mode to achieve a fast speed or movement with low loading force resistance (i.e., reduced relative 'stiffness' of the actuator) via the same independent IMV assembly. Accordingly, the subject invention is optimised for maximising efficiency of a mining machine so as to be capable of obtaining a desired fluid flow speed and pressure that may be proportionally adjusted so as to provide operation according to the cutting and idling modes in which at least one mechanical actuator is displaceable with a wide range of movement speeds and against a wide range of external forces (movement-resistive forces).

According to a first aspect of the present invention there is provided a hydraulic system to control at least two hydraulic actuators, the system comprising: a pump; a first and a second hydraulic actuator; a metering control valve assembly having a plurality of electrohydraulic valves, an inlet fluidly connected to the pump and an outlet fluidly connected to a drain or reservoir, the metering control valve assembly fluidly connected to the first hydraulic actuator; a transmission valve assembly having an electronically controllable valve fluidly connected to provide pilot control of a first and a second logic valve, the first and second logic valves fluidly connected to the metering control valve assembly; and the second hydraulic actuator fluidly connected to the metering control valve assembly via the first and second logic valves.

Preferably, the pump is a variable displacement pump. Optionally, the pump may comprise a constant pump or other pump configurations a will be appreciated by those skilled in the art.

Reference within this specification to a 'hydraulic actuator' encompass a hydraulic component having a main body or housing and at least one movable member capable of moving relative to the body or housing. The term hydraulic actuator includes a hydraulic cylinder such as a linear actuator having a cylinder body defining internal chambers separated by a piston with the piston coupled to an extendable and retractable shaft or arm. Optionally, the hydraulic actuator comprises a hydraulic motor.

Preferably, the system comprises at least four electrohydraulic valves in which a first pair of said valves is fluidly connected to the inlet and a second pair of said valves is fluidly connected to the outlet. Such an arrangement is beneficial to provide selective control of fluid flow speed and pressure to and from the actuator so as to provide a corresponding control of the movement or position of at least parts of the actuator.

Preferably, the system comprises a first and a second conduit fluidly connecting the first hydraulic actuator and the transmission valve assembly to the electrohydraulic valves; and a third and a fourth conduit fluidly connecting the second hydraulic actuator to the first and second logic valves respectively. Preferably, the first hydraulic actuator is coupled directly to the transmission valve assembly and in particular the electrohydraulic valves via the first and second conduits. Optionally, the second hydraulic actuator is coupled to the logic valves directly via the third and fourth conduits. Such an arrangement maintains to a minimum the number of components within the system for ease of maintenance and efficiency.

Preferably, the system comprises at least one or a plurality of sensors including in particular fluid flow sensors providing monitoring, output and response control of fluid pressure and flow speed (flow rate) within the system. Optionally, the sensors may be positioned at the valves, the conduits and/or the hydraulic actuators.

Optionally, the first hydraulic actuator is fluidly connected to the metering control valve assembly without fluid connection via the first and second logic valves and the second hydraulic actuator is fluidly connected to the metering control valve assembly via the first and second logic valves. Preferably, the first hydraulic actuator is coupled directly to the metering control valve assembly and the second hydraulic actuator is coupled directly to the transmission valve assembly. As such, a fluid flow speed and fluid pressure may be regulated exclusively via control of the metering control valve assembly without fluid routing via the transmission valve assembly.

Preferably, the system further comprises a first float logic valve fluidly connected to the second hydraulic actuator to allow fluid transfer between regions of the second hydraulic actuator when operated in a first mode.

Preferably, the system further comprises at least one further (i.e., third) hydraulic actuator fluidly connected to the first and second logic valves via the third and fourth conduits respectively.

Preferably, the electronically controllable valve is a solenoid control valve.

Preferably, the second and/or third hydraulic actuators are fluidly connected to the metering control valve assembly via the first and second logic valves. Preferably, the system further comprises a second float logic valve. The float logic valves are coupled directly to the respective second and third hydraulic actuators so as to minimise the fluid flow path length between the regions (i.e. internal chambers) of the actuators when operated in the first mode. Preferably, the float logic valves are pilot controlled via the transmission valve assembly and in particular the electronically controllable valve (i.e., solenoid control valve). Preferably, the float logic valves are connected to the electronically controllable valve via the same pilot fluid control circuit as the logic valves of the transmission valve assembly. Accordingly, the electronically controllable valve is configured to provide control of all logic valves within the system.

Optionally, the system further comprises a pressure reducing/relieving valve fluidly connected to an auxiliary logic valve, the pressure reducing/relieving valve fluidly connected to the pump and the auxiliary logic valve fluidly connected to at least the second hydraulic actuator. Preferably, the auxiliary logic valve is fluidly connected to the second hydraulic actuator via the third conduit. Preferably, the pressure reducing/relieving valve and the auxiliary logic valve are coupled to the drain or reservoir so as to provide further regulation of the fluid pressure at the hydraulic actuators and in particular to avoid cavitation.

Preferably, the hydraulic actuators comprises hydraulic cylinders having a first chamber and a second chamber, each respective chamber fluidly connected to the metering control valve assembly. Where the assembly comprises float logic valves, these logic valves are coupled to each of the first and second chambers such that when activated by the electronically controllable valve, at least some of the hydraulic actuators are capable of operating in a 'float' mode. Such a configuration is advantageous to control the number of 'positively activated' hydraulic actuators within the system with at least one hydraulic actuator being positively actuated by the metering control valve assembly and at least some of the hydraulic actuators being floating or idle when not supplied with fluid from the metering control valve assembly.

Preferably, the electrohydraulic valves are electrically controlled independently of one another. More preferably, the electronically controllable valve (i.e., the solenoid control valve) is electrically controlled independently of the electrohydraulic valves. Each of the electrohydraulic valves and the solenoid control valve may comprise suitable fluid flow rate and speed sensors that are in turn coupled or provided wired or wireless communication with an external control such as a computer, a network, a remote computer, processor based utility or server.

Preferably, the system comprises three hydraulic cylinders each having a first chamber and a second chamber wherein each of the first and second chambers of a first cylinder are fluidly connected directly to the electrohydraulic valves of the metering control valve assembly and each of the first and second chambers of a second and third cylinder are fluidly connected to the electrohydraulic valves of the metering control valve assembly via the logic valves of the transmission valve assembly. Such a system is particularly suitable to control a pivoting support arm of a bulk processing machine such as an undercutting mining machine.

Optionally, the electrohydraulic valves may comprise any one or a combination of proportional solenoid valves, directional control values or servo valves. Within this specification, reference to electrohydraulic valves encompasses valve types configured to control flow direction, flow volume and fluid pressure via electrical signal control of moving components (i.e., spools) within the valves. Such valves may be operated using AC or DC power.

According to a second aspect of the present invention there is provided mechanically actuating apparatus having a moveable member controlled by at least one hydraulic actuator of the hydraulic system as claimed herein.

Preferably, the mechanical actuating apparatus is an undercutting mining machine and the movable member is a support arm mounting at least one cutting head. Preferably, the hydraulic system is configured to control a pivoting of the arm at least in a direction laterally inward and outward relative to a main body or chassis of the mining machine. Optionally and additionally or alternatively, the hydraulic system may be configured to control a pivoting of the arm in a vertical plane (upward and downward direction).

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

A hydraulic system according to the present invention is capable of providing independent metering for controlled movement and static positioning of hydraulic actuators that in turn are coupled to mechanical members such as pivoting arms and the like. A specific implementation of the present hydraulic system is described with reference to movement and positional control of pivoting cutting arms of a mining undercutting machine. In particular, the present hydraulic system provides a configuration to change modes of operation of the movement of the cutting arms between for example a cutting mode in which an arm is controlled to move at slow speed and with high external load force resistance and an idling mode in which an arm is controlled to move at high speed and with low external load force resistance via the same hydraulic system.

Figure 1:
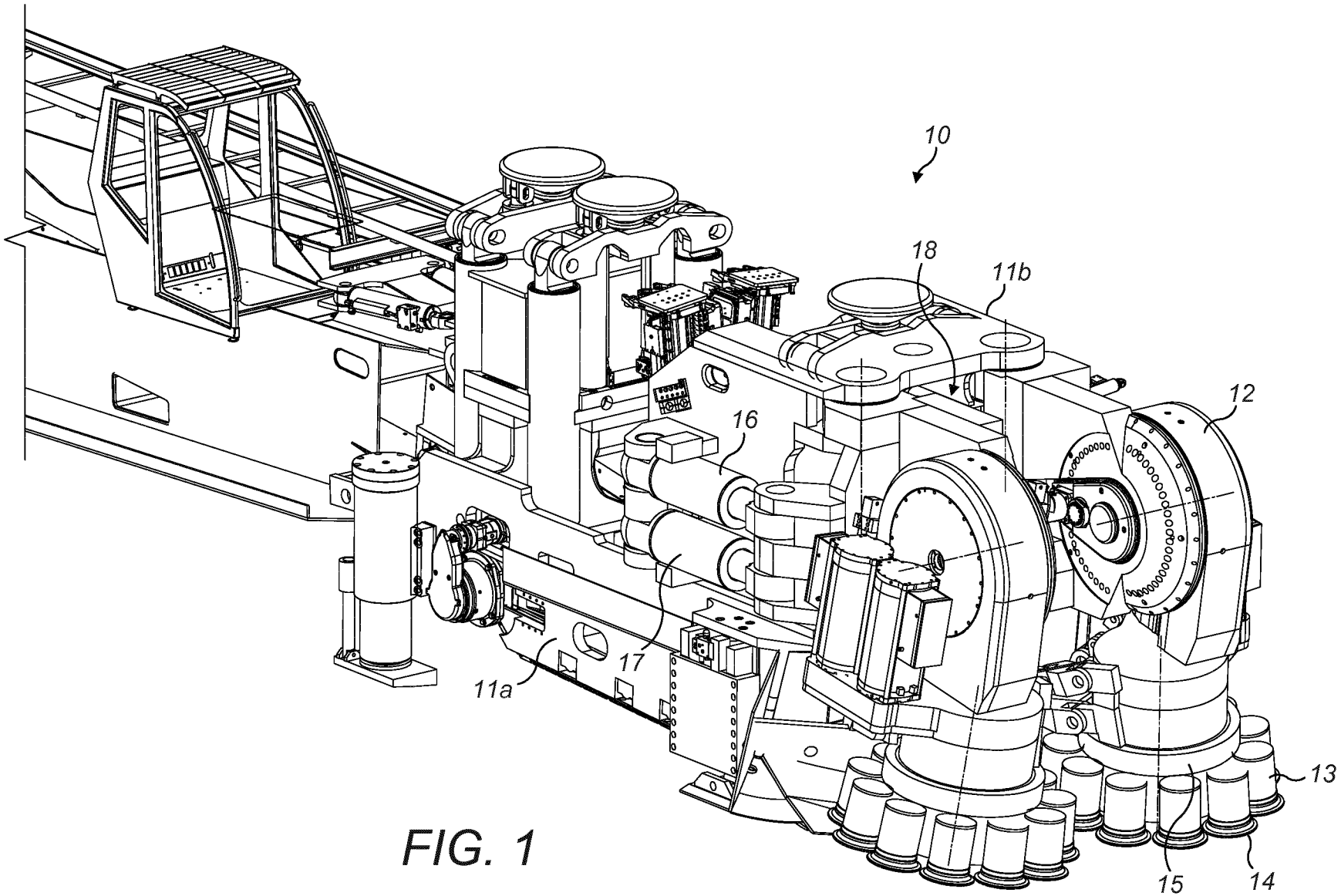
FIG. 1 is a perspective view of a mobile undercutting mining machine suitable for creating tunnels and subterranean roadways having a pair of forward mounted pivoting cutting arms each mounting a set of roller cutter units wherein each of the cutter arms are controlled by hydraulic actuators that are in turn controlled by a hydraulic system according to one aspect of the present invention.

Referring to FIG. 1, cutting apparatus 10 is configured to cut into rock within a mining environment to create drifts, subterranean roadways and the like so as to form an underground mine network. Apparatus 10 is configured for operation in an undercutting mode in which a plurality of rotatable roller cutter units 13 may be forced into the rock to create a groove or channel and then to be pivoted vertically upward so as to overcome the reduced tensile force immediately above the channel and break the rock. Accordingly, the cutting apparatus 10 is optimised for forward advancement into the rock using less force and energy typically required for conventional compression type cutters that utilise cutting bits or picks mounted at rotatable heads.

Apparatus 10 comprises a main frame 11*a* (or chassis) that mounts a sled 11*b* capable of sliding forward and aft along a forward region of the sled 11*a*. A pair of support arms 12 are mounted at a forward region of sled 11*b* and are configured with parts to pivot independently via a generally horizontal pivot axis and a generally vertical pivot axis. A respective cutting head 15 is mounted at the distal end of each arm 12 and by rotation about the respective horizontal and vertical pivot axes is capable of being raised in a vertical plane (up and down) and to be slewed laterally in a horizontal plane (side-to-side). Each cutting head 15 mounts a plurality of cutter units 13, with each unit 13 rotatably mounting a respective cutter ring 14 (otherwise referred to as a roller cutter). As will be appreciated, apparatus 10 further comprises additional components associated with conventional undercutting apparatus including in particular an electric motor, jacking legs, tracks etc.

The lateral slewing movement of each arm 12 is provided by selective actuation of a first pair of externally mounted hydraulic cylinders 16, 17 and an internally mounted hydraulic cylinder 18, with each of the three cylinders being configured to control one of the two arms via linear extension and retraction of the piston shafts as will be appreciated.

Figure 4:
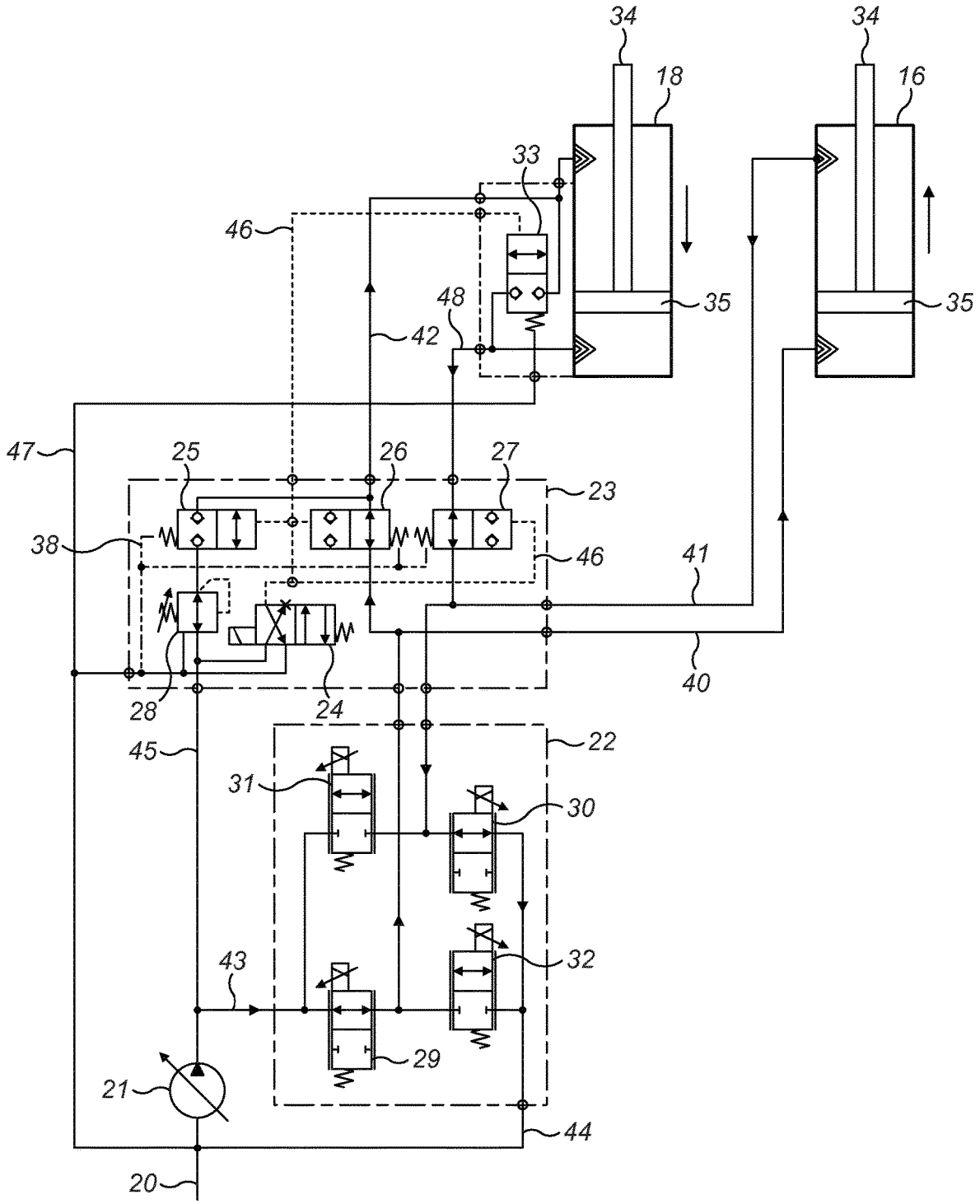
FIG. 4 is a schematic illustration of a hydraulic control system implemented to control movement of an actuator for slow movement and with high external force resistance in a first direction according to one aspect of the present invention.
Figure 5:
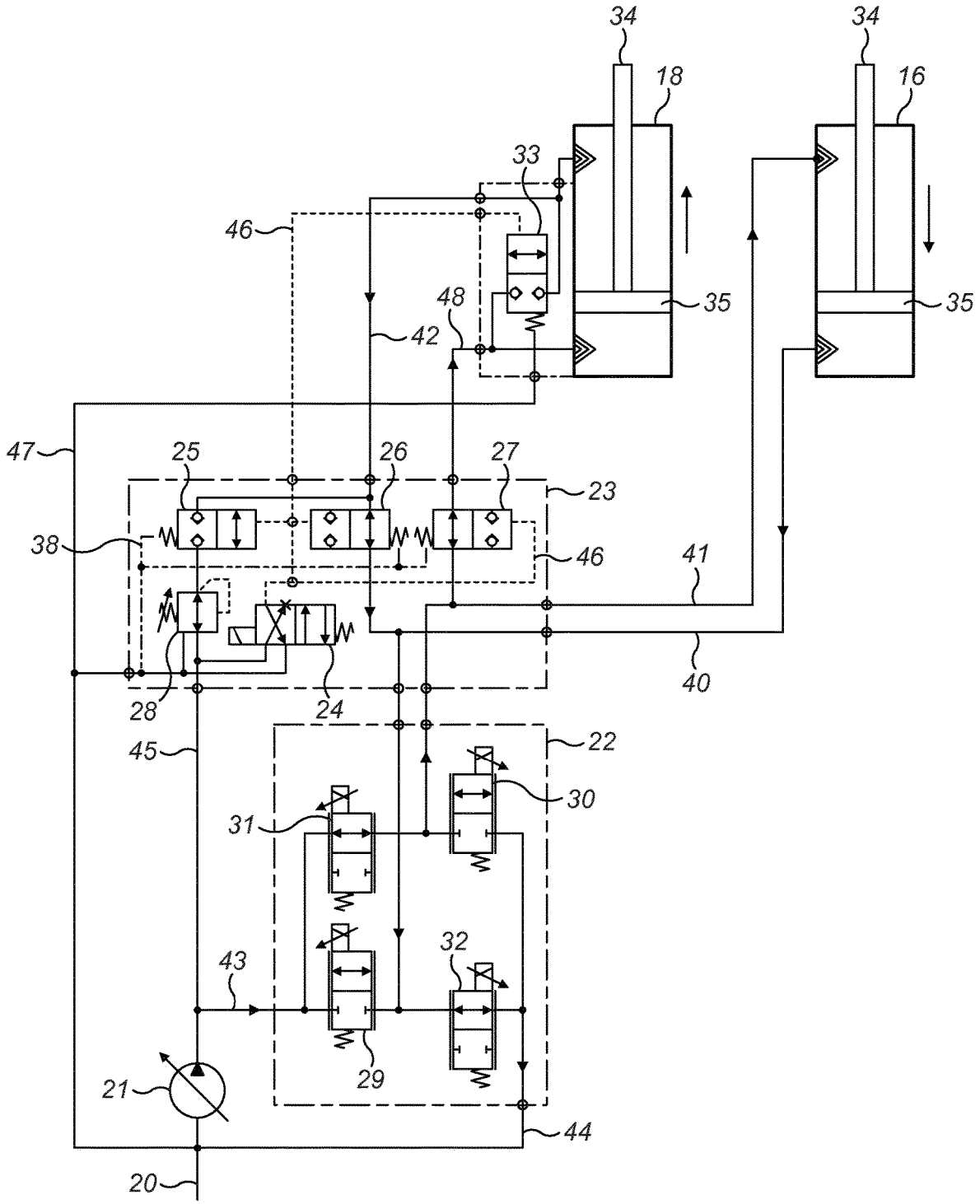
FIG. 5 is a schematic illustration of a hydraulic control system implemented to control movement of an actuator for slow movement and with high external force resistance in a second direction according to one aspect of the present invention.
Figure 6:
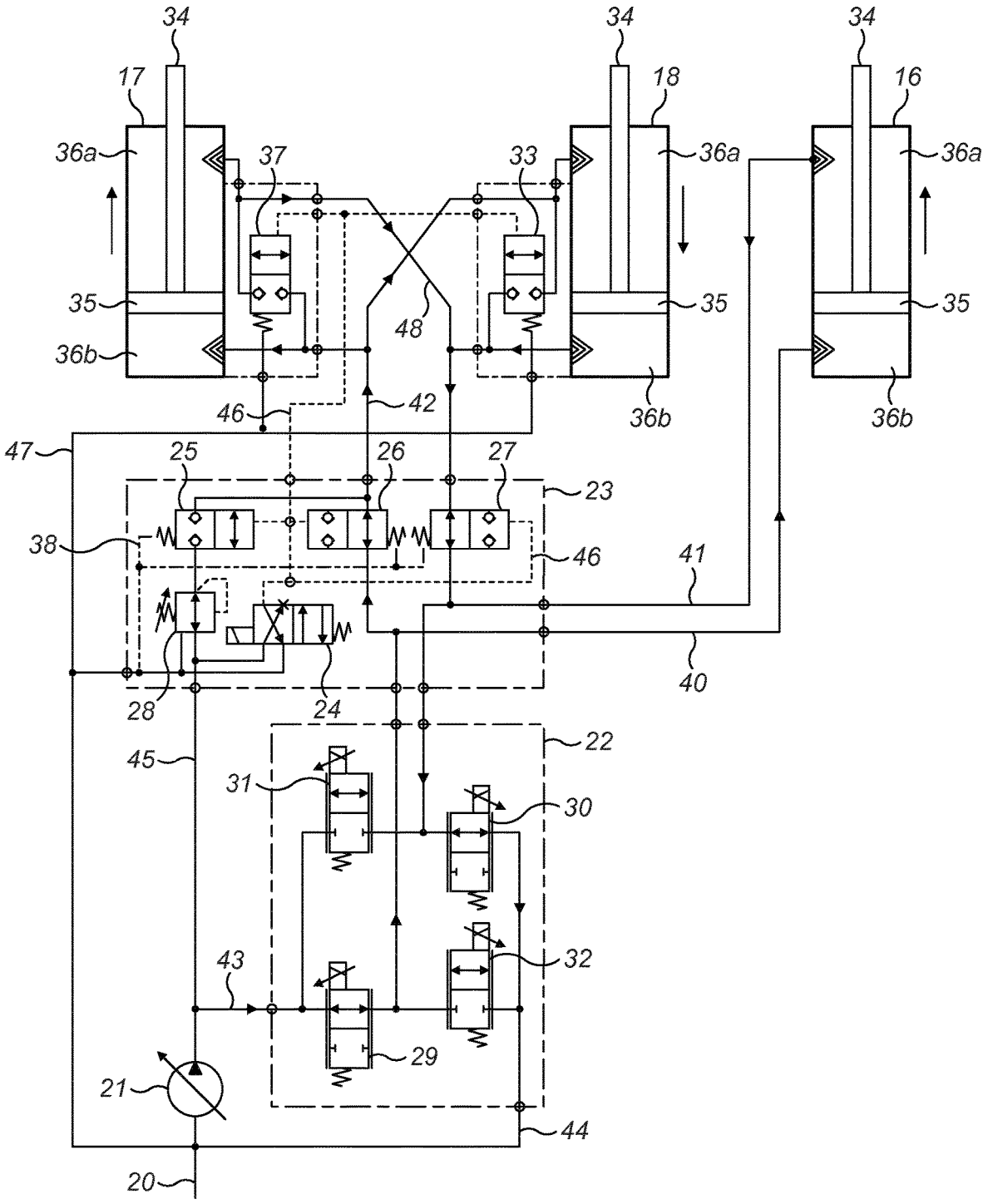
FIG. 6 is a schematic illustration of a hydraulic system according to a further embodiment of the present invention comprising three hydraulic actuators implemented to control movement of an actuator for slow movement and with high external force resistance in a first direction.

FIGS. 2 to 5 illustrate a first embodiment of the subject invention configured to provide actuation control of two hydraulic cylinders 16, 18. FIG. 6 illustrates a further embodiment configured for control of three hydraulic cylinders 16, 17, 18 illustrated by way of example to control each arm 12 of the mining machine of FIG. 1. Referring to the embodiment of FIGS. 2 to 5 the hydraulic system comprises a variable displacement pump 21 fluidly connected to a drain or reservoir 20. A metering control valve assembly 22 is fluidly connected via an inlet conduit 43 to pump 21. Metering control valve assembly 22 is also fluidly connected to a drain or reservoir 20 via outlet conduit 44. Valve assembly 22 comprises four electrohydraulic valves implemented as proportional solenoid valves 29, 30, 31, 32 fluidly connected to each other, the inlet and outlet conduits 43, 44 and a first 40 and a second 41 conduit extending from assembly 22 to provide fluid connection with hydraulic actuator 16. As illustrated, actuator 16 comprises a cylindrical housing mounting a piston 35 coupled to a piston rod or shaft 34 capable of linear extension and retraction from the cylinder housing. First and second internal chambers 36*a*, 36*b* are partitioned by piston 35 with each chamber 36*a*, 36*b* coupled respectively to the conduits 41, 40 and in turn the metering control valve assembly 22. The first and second conduits 40, 41 are positioned in fluid connection with the proportional solenoid valves 29, 30, 31, 32 at a position (in fluid connection) between respective pairs of valves 29, 32 and 30, 31. That is, each of the proportional solenoid valves 29 to 32 are fluidly connected together in a loop with the first and second conduits 40, 41 fluidly coupled at regions on opposite sides of the loop.

The hydraulic system further comprises a transmission valve assembly 23 comprising a pair of logic valves 26, 27, a solenoid control valve 24, a pressure reducing/relieving valve 28 and an auxiliary logic valve 25. Solenoid control valve 24 is fluidly connected via pilot conduit 46 to logic valves 26, 27 and is also fluidly connected to pump 21 via supply conduit 45. Logic valve 26 is fluidly connected to the metering control valve assembly 22 via the first conduit 40 and the second logic valve 27 is fluidly connected to the metering control valve assembly 22 via the second conduit 41. The pressure reducing/relieving valve 28 is fluidly connected to the first, second and auxiliary logic valves 25, 26, 27 via a reducing/relieving conduit 38, with valve 28 also being fluidly coupled to pump 21 via supply conduit 45.

The second hydraulic actuator 18 comprises the same configuration as the first actuator 16 and is coupled in fluid connection to the transmission valve assembly 23 via a third conduit 42 and a fourth conduit 48. Third conduit 42 provides fluid connection between the second actuator first chamber 36*a* and the first logic valve 26 and the fourth conduit 48 provides fluid connection between the second actuator second chamber 36*b* and the second logic valve 27. A first float logic valve 33 is provided at the second actuator 18 and is coupled to provide a fluid flow circuit between the first and second chambers 36*a*, 36*b*. Float logic valve 33 is coupled to the pilot conduit 46 so as to be pilot controlled by the solenoid control valve 24. Float logic valve 33 is also coupled to the third and fourth conduits 42, 48. Each of the valves 24, 25, 26, 27, 28 and 33 are all fluidly coupled to a further reducing/relieving conduit 47 which is in turn fluidly connected to the drain or reservoir 20. Additionally, auxiliary logic valve 25 is further fluidly connected to the third conduit 42 so as to be positioned in a fluid flow direction intermediate the pressure reducing/relieving valve 28 and the second actuator 18.

Accordingly, first actuator 16 is fluidly connected directly to the metering control valve assembly 22 via first and second conduits 40, 41. Second actuator 18 is coupled indirectly to the metering control valve assembly 22 via the transmission valve assembly 23 and in particular fluid connection via the third and fourth conduit 42, 48 and the respective first and second logic valves 26, 27 (that are in turn coupled to the first and second conduits 40, 41).

According to the specific implementation, the first and second logic valves 26, 27 are 'normally open'; the auxiliary logic valve 25 is 'normally closed' such that when solenoid control valve 24 is actuated, logic valves 26, 27 are closed whilst auxiliary logic valve 25 is open. Accordingly, when solenoid control valve 24 is deactivated valves 26, 27 are open and valve 25 is closed. Additionally, float logic valve 33 is 'normally closed' and like auxiliary logic valve 25, is configured to be open by actuation of solenoid control valve 24.

Figure 2:
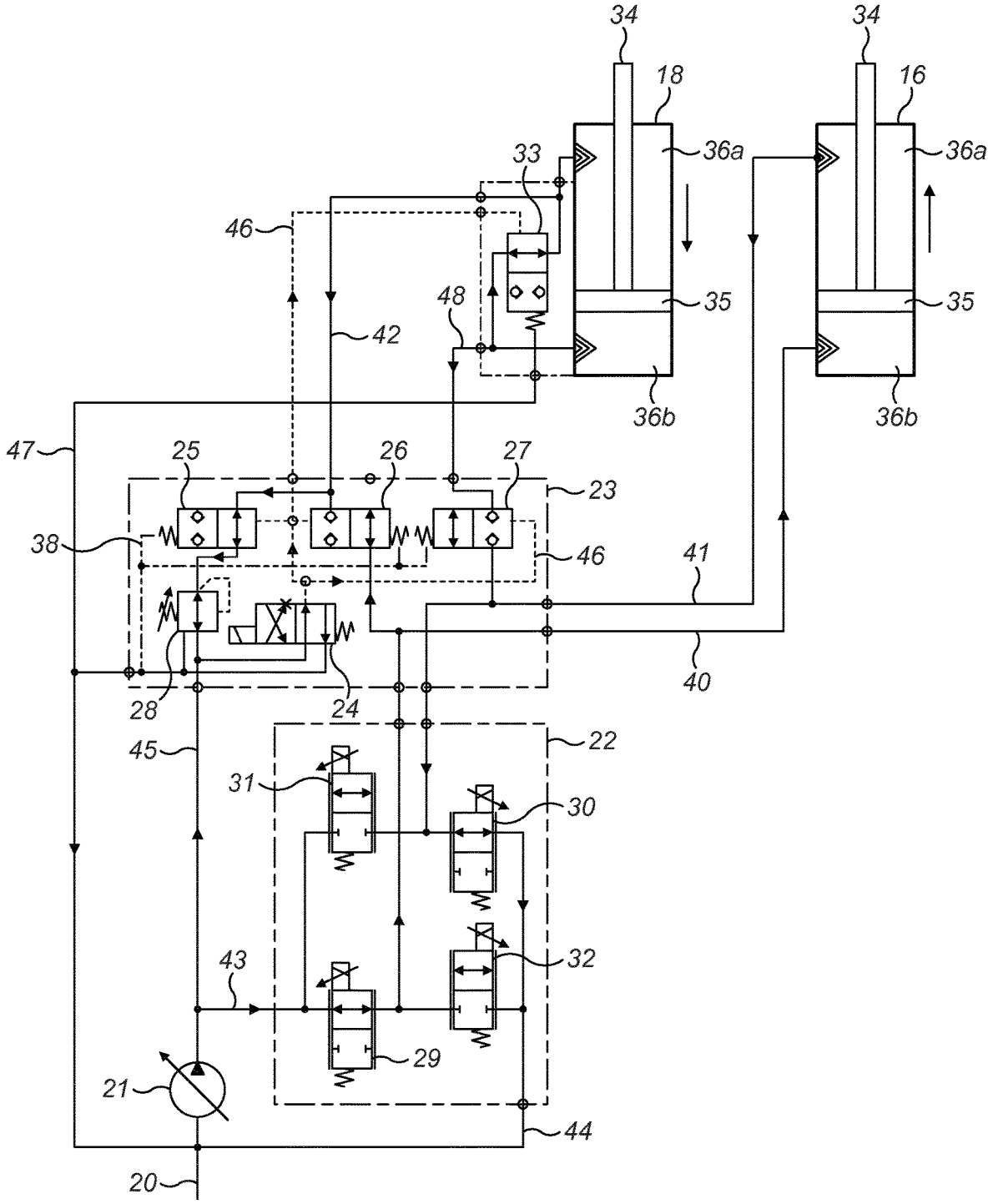
FIG. 2 is a schematic illustration of a hydraulic control system implemented to control movement of an actuator for fast movement and with low external force resistance in a first direction according to one aspect of the present invention.
Figure 3:
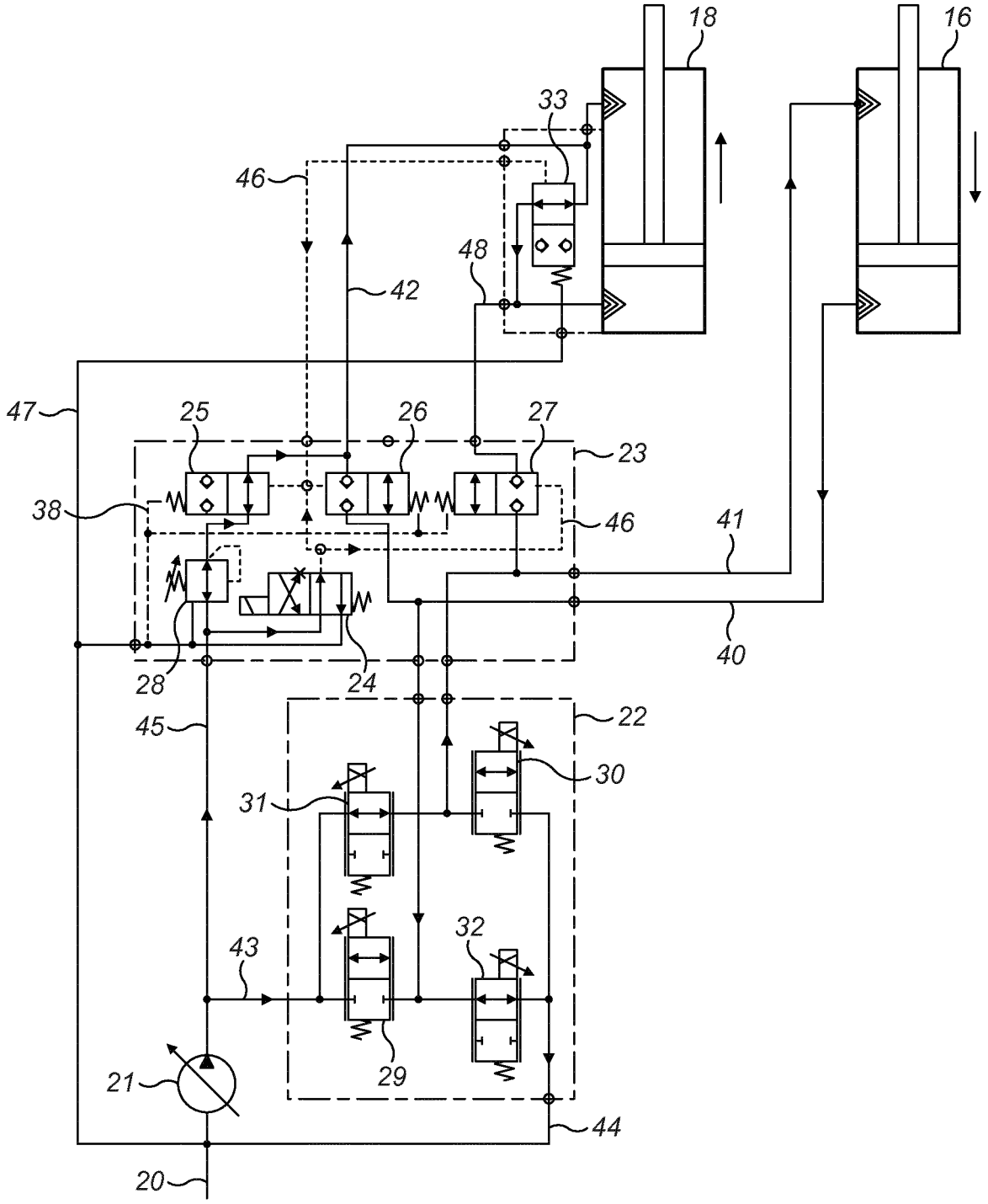
FIG. 3 is a schematic illustration of a hydraulic control system implemented to control movement of an actuator for fast movement and with low external force resistance in a second direction according to one aspect of the present invention.

FIG. 2 illustrates control of cylinders 16 and 18 when apparatus 10 (mining machine) and in particular arm 12 is in an 'idling' mode so as to provide fast movement of arm 12 under low external load force in a first movement direction; FIG. 3 illustrates operation of the hydraulic system with the cylinders 16 and 17 operating in the same idling mode but in the reverse direction; FIG. 4 illustrates control of the cylinders 16 and 18 in a 'cutting' mode in which arm 12 is moved slowly and is maintained in a more 'stiff' configuration so as to withstand high external load force moving in a first direction and; FIG. 5 illustrates control of cylinders 16 and 18 in the same 'cutting' mode of FIG. 4 with the arm 12 moving in the opposite direction with approximately the same slow speed and similar high load balancing. FIG. 6 illustrates the embodiment of the present system controlling three linear hydraulic actuators 16, 17 and 18 as will be described in further detail below.

As will be appreciated, the proportional solenoid valves 29 to 32 are configured to selectively regulate fluid flow speed and pressure via independent electronic controls. The fluid flow and valve control configuration is described with reference to FIG. 2 and it will be appreciated that corresponding fluid flow directions and valve control configurations are applied equally to the different modes and operation of the linear actuators 16, 18 according to the desired direction of movement of the shafts 34 according to FIGS. 3 to 5. As illustrated in FIG. 2, fluid is supplied to the metering control valve assembly 22 via pump 21 and inlet conduit 43. Fluid is then supplied at the desired rate and pressure to cylinder second chamber 36*b* via first conduit 40. Fluid from cylinder first chamber 36*a* is directed to the drain or reservoir 20 via the second conduit 41, the metering control valve assembly 22 and the outlet conduit 44. In this configuration, cylinder 16 is 'active' whilst cylinder 18 is maintained in a 'floating' mode without fluid supply from the metering control valve assembly 22. In this mode of operation, fluid flows from first chamber 36*a* of second cylinder 18 to the second chamber 36*b* via float logic valve 33. Excess fluid (due to the difference in chamber size) from the first chamber 36*a* is transferred to the reducing/relieving conduit 47 via third conduit 42, auxiliary logic valve 25 and pressure reducing/relieving valve 28. This mode of operation according to FIG. 2 is provided by activating solenoid 24 to close valves 26, 27 and open valve 25. In the reverse flow direction illustrated in FIG. 3, the pressure reducing/relieving valve 28 is controlled to provide the reverse fluid flow direction through auxiliary logic valve 25 so as to provide the opposite fluid flow direction between the first and second chambers 36*a*, 36*b* of second cylinder 18. Naturally, the reverse fluid flow direction through first and second conduits 40, 41 is provided by the selective electronic control of the four proportional solenoid valves 29 to 32.

Referring to FIGS. 4 and 5, where it is required to actuate cylinders 16 and 18 according to the 'cutting' mode (i.e. with slow speed and high stiffness/high external load force resistance) solenoid control valve 24 is deactivated so as to allow fluid flow from metering control valve assembly 22 to the second cylinder 18 via logic valve 26. In this configuration, the metering control valve assembly 22 is provided in fluid connection to both cylinders 16, 18 and accordingly the fluid flow speed and pressure is divided approximately equally to achieve a higher force resistance and a proportionally lower actuation speed relative to the 'fast' mode of operation of FIGS. 2 and 3. In such a configuration the pressure reducing/relieving valve 28 and the auxiliary logic valve 25 are isolated from the fluid flow at the first, second, third and fourth conduits 40, 41, 42 and 48.

The components, construction and functionality of the embodiment of FIG. 6 is the same as the embodiment of FIGS. 2 to 5 save for the additional actuator 17 and a corresponding additional float logic valve 37 (associated with the actuator 17). As illustrated, the second and third actuators 18, 17 are fluidly connected via the third and fourth conduits 42, 48 and in particular the first chamber 36*a* of the second actuator 18 is coupled to the second chamber 36*b* of the third actuator 17 via the third conduit 42 and the second chamber 36*b* of the second actuator 18 is coupled to the first chamber 36*a* of the third actuator via the fourth conduit 48. Accordingly, excess fluid from the first respective chamber 36*a* may be transferred to the respective to the second chamber 36*b* of the alternate actuator 18, 17 when the second and third actuators 18, 17 are operated in 'float' or 'idling' mode and not driven directly by the metering control valve assembly 22. As with the embodiment of FIGS. 2 to 5, regulation of the fluid supply pressure and flow rate to the second and third actuators 18, 17 is controlled via the metering control valve assembly 22 when solenoid control valve 24 is deactivated and the logic valves 26 and 27 are opened as default. As will be appreciated, the third actuator 17 is configured for the same corresponding directional movement of the first actuator 16 such that first and third actuators 16, 17 are motion paired and the second actuator 18 is operable in the corresponding reverse stroke direction. As with the embodiment of FIGS. 2 to 5, both the second and third actuators 18, 17 and in particular the respective first and second chambers 36*a*, 36*b* are fluidly coupled to the drain or reservoir 20 via the reducing/relieving conduit 47, the third conduit 42, the auxiliary logic valve 25 and the pressure reducing/relieving valve 28 so as to provide regulation of the fluid flow given the respective differences in the volumes of the first and second chambers 36*a*, 36*b*. Additionally, and as with the embodiment of FIGS. 2 to 5, the auxiliary logic valve 25 and the associated pressure reducing/relieving valve 28 are capable of supplying a constant pressure to the second and third actuators 18, 17 and of avoiding cavitation via fluid connection to the drain or reservoir 20 via reducing/relieving conduit 47.

The present hydraulic system provides a mechanism and a method of controlling the speed of pivoting movement of the arms 12 in the lateral inward and outward direction in addition to providing control of the 'stiffness' of the movement and hence a relative resistance to the external load applied to the arms primarily resultant from contact with the rock strata when in cutting mode. For example, and in a fast mode of operation, only the first actuator 16 is positively displaced by metering control valve assembly 22 corresponding to a non-cutting operation as the arm 12 is returned to an in-board position. In a cutting mode, all three actuators 16, 17, 18 are positively displaced so as to distribute the applied fluid pressure from the metering control valve assembly 22 and to provide greater resistance to the external load as the cutting units 13 are forced against the rock strata during cutting. A maximum load would be encountered for example when arm 12 is extended fully (orientated approximately 90° to the orientation of FIG. 1) via pivoting of the arm 12 about the generally horizontal axis). In such a position, proportional solenoid valves 29 to 32 would be controlled so as to deliver maximum pressure to the actuators 16, 17, 18 with low fluid flow speed.

By utilising proportional solenoid valves, at least one solenoid control valve and logic valves, the present hydraulic system provides a versatile mechanism and method for quantitative adjustment of the speed of movement and force of displacement of the actuators 16, 17, 18 according to predefined operating conditions.

The invention claimed is:

1. A hydraulic system to control at least two hydraulic actuators, the system comprising:

a pump;

a first and a second hydraulic actuator;

a metering control valve assembly having a plurality of electrohydraulic valves, an inlet fluidly connected to the pump and an outlet fluidly connected to a drain or reservoir, the metering control valve assembly fluidly connected to the first hydraulic actuator; and a transmission valve assembly having an electronically controllable valve fluidly connected to provide pilot control of a first and a second logic valve, the first and second logic valves being fluidly connected to the metering control valve assembly, wherein the second hydraulic actuator is fluidly connected to the metering control valve assembly via the first and second logic valves.

2. The system as claimed in claim 1, comprising at least four electrohydraulic valves in which a first pair of said valves is fluidly connected to the inlet and a second pair of said valves is fluidly connected to the outlet.

3. The system as claimed in claim 1, further comprising a first and a second conduit fluidly connecting the first hydraulic actuator and the transmission valve assembly to the electrohydraulic valves; and a third and a fourth conduit fluidly connecting the second hydraulic actuator to the first and second logic valves respectively.

4. The system as claimed in claim 3, wherein the first hydraulic actuator is fluidly connected to the metering control valve assembly without fluid connection via the first and second logic valves and the second hydraulic actuator is fluidly connected to the metering control valve assembly via the first and second logic valves.

5. The system as claimed in claim 1, further comprising a first float logic valve fluidly connected to the second hydraulic actuator to allow fluid transfer between regions of the second hydraulic actuator when operated in a first mode.

6. The system as claimed in claim 1, further comprising a third hydraulic actuator fluidly connected to the first and second logic valves via the third and fourth conduits respectively.

7. The system as claimed in claim 6, wherein the second and/or third hydraulic actuators are fluidly connected to the metering control valve assembly via the first and second logic valves.

8. The system as claimed in claim 5, further comprising a third hydraulic actuator fluidly connected to the first and second logic valves and a second float logic valve fluidly connected to the third hydraulic actuator to allow fluid transfer between regions of the third hydraulic actuator when operated in the first mode.

9. The system as claimed in claim 5, further comprising a pressure reducing/relieving valve fluidly connected to an auxiliary logic valve, the pressure reducing/relieving valve being fluidly connected to the pump and the auxiliary logic valve fluidly connected to at least the second hydraulic actuator.

10. The system as claimed in claim 9, wherein the auxiliary logic valve is fluidly connected to the second hydraulic actuator via the third conduit.

11. The system as claimed in claim 1, wherein the hydraulic actuators include hydraulic cylinders having a first chamber and a second chamber, each respective chamber fluidly connected to the metering control valve assembly.

12. The system as claimed in claim 1, wherein each of the electrohydraulic valves are electrically controlled independently of one another.

13. The system as claimed in claim 1, wherein the electronically controllable valve is a solenoid control valve electrically controlled independently of the electrohydraulic valves.

14. The system as claimed in claim 1, comprising three hydraulic cylinders each having a first chamber and a second chamber, wherein each of the first and second chambers of a first cylinder is fluidly connected directly to the electrohydraulic valves of the metering control valve assembly and each of the first and second chambers of a second and third cylinder are fluidly connected to the electrohydraulic valves of the metering control valve assembly via the logic valves of the transmission valve assembly.

15. A mechanical actuating apparatus having a moveable member controlled by at least one hydraulic actuator of the hydraulic system as claimed in claim 1.

16. The apparatus as claimed in claim 15, wherein the mechanical actuating apparatus is an undercutting mining machine and the movable member is a support arm mounting at least one cutting head.

17. The apparatus as claimed in claim 16, wherein the hydraulic system is configured to control a pivoting of the support arm in a direction laterally inward and outward relative to a main body or chassis of the mining machine.

* * * * *